US011761170B2

(12) United States Patent
Busquets et al.

(10) Patent No.: US 11,761,170 B2
(45) Date of Patent: Sep. 19, 2023

(54) APPARATUS FOR FACILITATING BUCKET MOVEMENT

(71) Applicant: Robert Bosch GmbH, Stuttgart (DE)

(72) Inventors: Enrique Busquets, Fountain Inn, SC (US); Rafael Rodrigues Cardoso, Simpsonville, SC (US); Vincenzo Bollero, Turin (IT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/528,613

(22) Filed: Nov. 17, 2021

(65) Prior Publication Data

US 2023/0151582 A1 May 18, 2023

(51) Int. Cl.

| | |
|---|---|
| ***E02F 9/20*** | (2006.01) |
| ***E02F 3/43*** | (2006.01) |
| ***G05G 9/04*** | (2006.01) |
| ***G05G 9/047*** | (2006.01) |
| ***H01H 25/04*** | (2006.01) |
| *E02F 9/22* | (2006.01) |

(52) U.S. Cl.

CPC ..... *E02F 9/2012* (2013.01); *E02F 3/431* (2013.01); *G05G 9/047* (2013.01); *H01H 25/04* (2013.01); *E02F 9/2228* (2013.01); *E02F 9/2235* (2013.01); *E02F 9/2285* (2013.01); *E02F 9/2292* (2013.01); *E02F 9/2296* (2013.01); *G05G 2009/04774* (2013.01)

(58) Field of Classification Search

CPC ..... E02F 3/431; E02F 9/2012; E02F 9/2228; E02F 9/2235; E02F 9/2285; E02F 9/2292; E02F 9/2296; G05G 9/047; G05G 2009/04774

See application file for complete search history.

(56) References Cited

U.S. PATENT DOCUMENTS

| | | | | |
|---|---|---|---|---|
| 5,235,809 | A | 8/1993 | Farrell | |
| 5,287,699 | A | 2/1994 | Takamura et al. | |
| 5,860,231 | A | 1/1999 | Lee et al. | |
| 6,725,105 | B2 | 4/2004 | Francis et al. | |
| 6,757,992 | B1 | 7/2004 | Berger et al. | |
| 6,763,661 | B2 | 7/2004 | Tabor et al. | |
| 6,863,144 | B2 * | 3/2005 | Brandt | E02F 9/205 74/471 XY |
| 7,062,350 | B2 | 6/2006 | Peterson | |
| 7,117,952 | B2 | 10/2006 | Bares et al. | |
| 7,269,943 | B2 | 9/2007 | Buckmier et al. | |

(Continued)

*Primary Examiner* — Adam D Rogers

(74) *Attorney, Agent, or Firm* — Michael Best & Friedrich LLP

(57) ABSTRACT

An apparatus for facilitating bucket movement of a material handling machine includes a joystick biased to a neutral position, movable away from the neutral position in a first direction along an axis to a first position, and movable away from the neutral position in a second direction along the axis, opposite the first direction, to a second position. The apparatus further includes an operator input movable from a disengaged position to an engaged position in which a bucket of the material handling machine is configured to automatically move in an oscillatory motion. When the operator input is in the engaged position, an intensity of the oscillation is dependent upon a position of the joystick along the axis, decreasing along the axis from the first position to the second position.

20 Claims, 3 Drawing Sheets

(56) References Cited

U.S. PATENT DOCUMENTS

| | | | | |
|---|---|---|---|---|
| 7,467,514 | B2 * | 12/2008 | Patel | E02F 9/221 60/381 |
| 7,571,604 | B2 | 8/2009 | Vigholm et al. | |
| 7,712,309 | B2 | 5/2010 | Vigholm | |
| 7,726,125 | B2 | 6/2010 | Brinkman et al. | |
| 8,869,520 | B2 | 10/2014 | Vigholm et al. | |
| 9,085,440 | B2 | 7/2015 | Choi | |
| 9,556,589 | B2 * | 1/2017 | Brooks | E02F 9/221 |
| 10,113,564 | B2 | 10/2018 | Stavron | |
| 10,246,855 | B2 * | 4/2019 | Greer | E02F 3/3414 |
| 10,597,845 | B2 | 3/2020 | Kenkel et al. | |
| 2005/0203691 | A1 | 9/2005 | Kim | |
| 2015/0134209 | A1 | 5/2015 | Lee | |

* cited by examiner

APPARATUS FOR FACILITATING BUCKET MOVEMENT

BACKGROUND

Industrial and construction machines such as skid steer loaders, compact wheel loaders, and mini-excavators include a bucket implement. The bucket implement is used to pick up various materials, which may become lodged in the bucket. In order to dislodge the stuck material, an operator can perform a "bucket shake" operation by moving the joystick back and forth quickly between "dump" and "curl" positions to quickly shake the bucket.

SUMMARY

The present disclosure relates to an apparatus for facilitating bucket movement of a material handling machine. The apparatus includes a first operator input movable between a neutral position, a first position and a second position. The apparatus further includes a second operator input actuatable from a disengaged position to an engaged position, the first operator input operable in a first mode of operation when the second operator input is in the disengaged position and operable in a second mode of operation when the second operator input is in the engaged position. In the first mode of operation, the first operator input is configured to curl a bucket of the apparatus when displaced from the neutral position toward the first position and is configured to dump the bucket of the apparatus when displaced from neutral position toward the second position. In the second mode of operation, the bucket is configured to move in an oscillatory motion and an intensity of the oscillatory motion is dependent upon a position of the first operator input. The intensity of the oscillatory motion is a first intensity when the first operator input is in the neutral position. The intensity of the oscillatory motion is increased relative to the first intensity to a second intensity at the first position. The intensity of the oscillatory motion is decreased relative to the first intensity to a third intensity at the second position.

The present disclosure relates further to an apparatus for facilitating bucket movement of a material handling machine. The apparatus includes a joystick biased to a neutral position and movable from the neutral position to a maximum dump position and a maximum curl position. The apparatus further includes an operator input movable between a disengaged position and an engaged position. A bucket of the material handling machine is configured to automatically move in an oscillatory motion when the operator input is in the engaged position, regardless of a position of the joystick. An intensity of the oscillation is dependent upon the position of the joystick, a maximum intensity corresponding to the joystick in one of the maximum dump position or the maximum curl position, and a minimum intensity corresponding to the joystick in the other one of the maximum dump position or the maximum curl position.

The present disclosure further relates to an apparatus for facilitating bucket movement of a material handling machine, the apparatus includes a joystick biased to a neutral position, movable away from the neutral position in a first direction along an axis to a first position, and movable away from the neutral position in a second direction along the axis, opposite the first direction, to a second position. The apparatus further includes an operator input movable from a disengaged position to an engaged position in which a bucket of the material handling machine is configured to automatically move in an oscillatory motion. When the operator input is in the engaged position, an intensity of the oscillation is dependent upon a position of the joystick along the axis, decreasing along the axis from the first position to the second position.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect.

Figure 1:
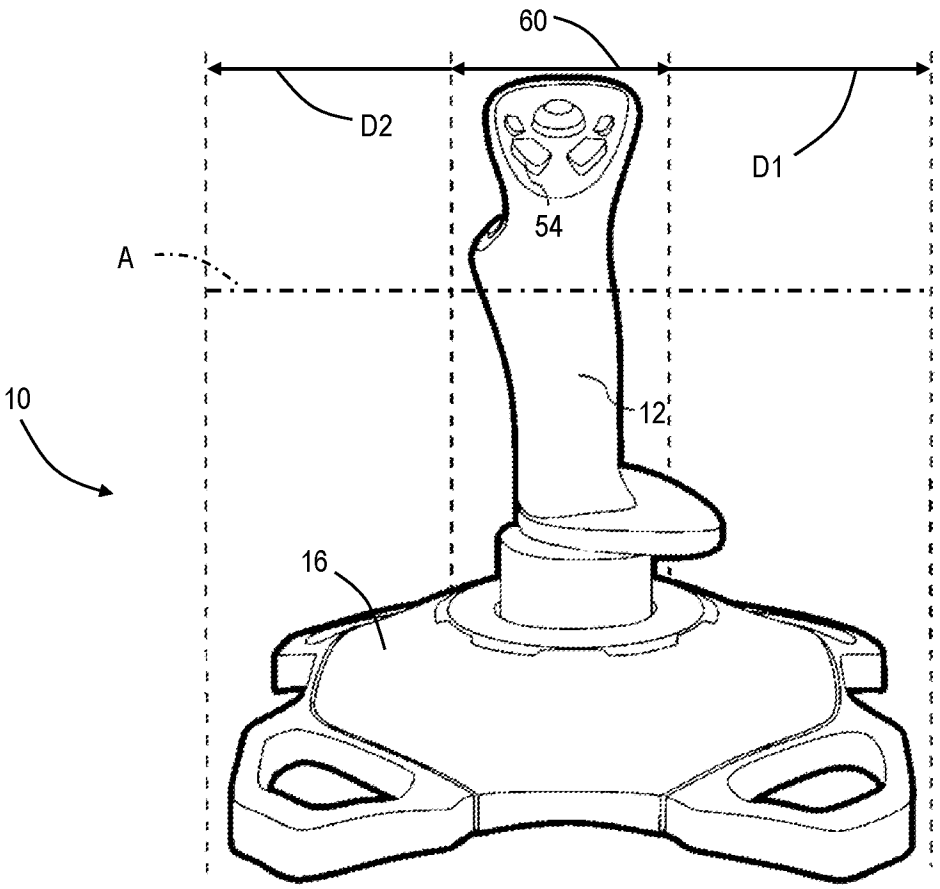
FIG. 1 is a representation of an operator input for controlling operation of a material handling machine.

FIG. 1 illustrates an example of a first operator input, shown as a joystick 10 that includes a joystick handle 12 and a base 16. In various systems, for example, a material handling machine 18 such as a front-loader vehicle (e.g., skid steer loader, compact track loader, mini-excavator, wheel loader, compact wheel loader, backhoe loader), the joystick handle 12 is manipulated to move relative to the base 16 to control the movement and operation of the system. Moving the joystick 10 may involve rotating or pivoting the joystick about a point of rotation defined within the base such that a distal end of the joystick handle 12 moves relative to the base 16. The joystick 10 outputs a position signal indicative of the position of the handle 12 relative to the base 16. This position signal typically defines the current displacement of the joystick handle 12 from a home origin position in either Cartesian or radial coordinates. Although the examples described below refer primarily to Cartesian coordinates (i.e., (x, y)), various aspects of the system can be adapted to function with radial coordinate systems.

Figure 2:
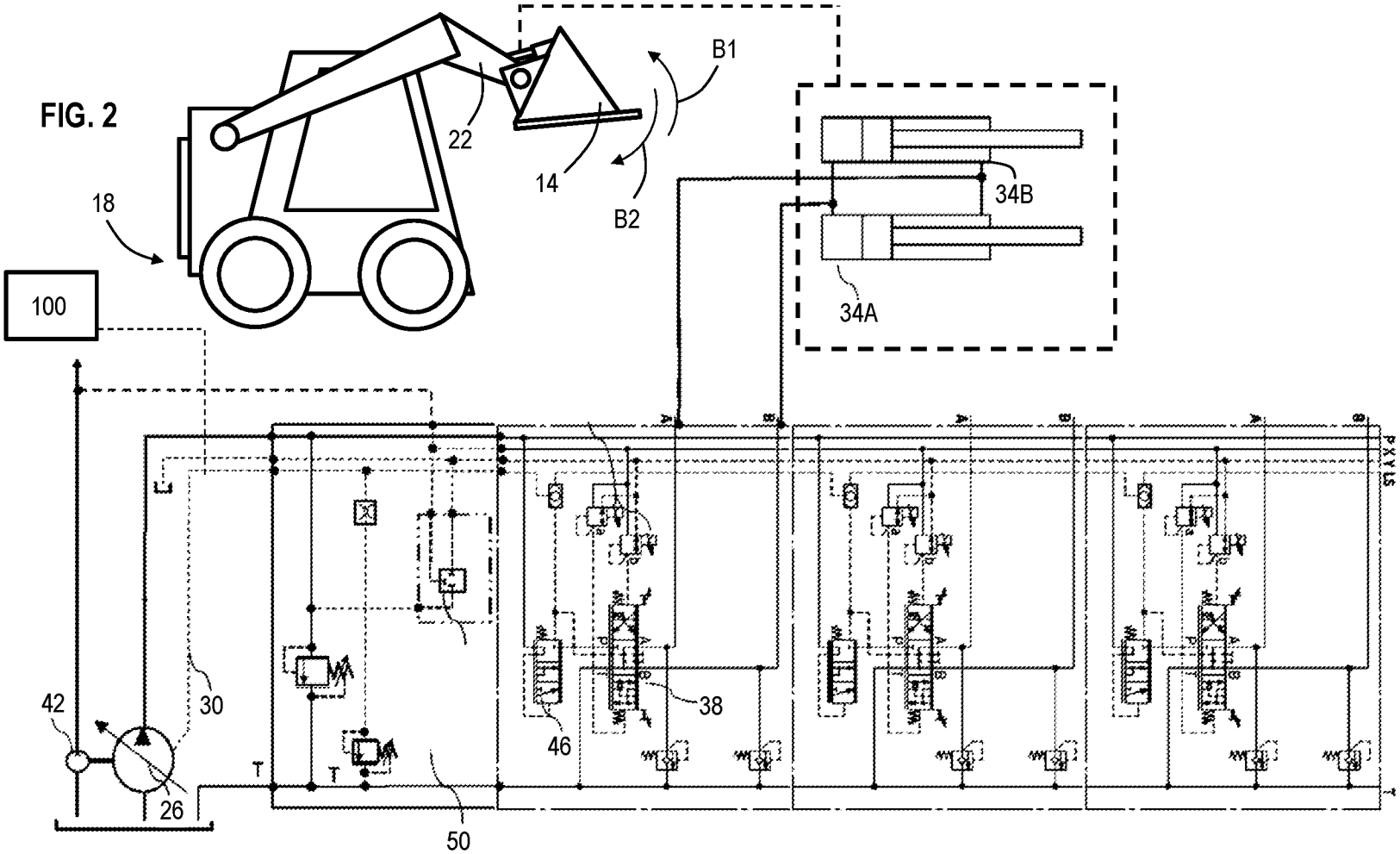
FIG. 2 is a schematic representation of a hydraulic system and an associated bucket of the material handling machine.

The joystick 10 controls operation of a bucket 14 of a material handling machine 18 (see FIG. 2). The bucket 14 is hydraulically coupled to a boom or lift arm 22 and is rotatable relative to the lift arm 22 to facilitate digging, lifting, carrying, and dumping material such as dirt, gravel, and debris. The bucket 14 rotates in a first direction B1 to curl the bucket 14 in a curl operation. The bucket 14 rotates in a second direction B2 to dump the bucket 14 in a dump operation.

The handle 12 of the joystick 10 is a user-engageable handle that is movable from a neutral position (as shown in FIG. 1) to a plurality of different positions that control a hydraulic aspect of the material handling machine 18. The neutral position is a central position, and the joystick 10 is biased to the neutral position. The joystick 10 is movable from the neutral position along at least a linear path defined as a first axis A and, in some embodiments, along a second linear path defining a second axis as well. When the joystick 10 is moved from the neutral position in a first direction D1 along the first axis A, the bucket 14 of the material handling machine 18 moves in the first, curl direction B1 toward a curl position. When the joystick 10 is moved from the neutral position in a second direction D2, opposite the first direction D1, along the first axis A, the bucket 14 moves in the second, dump direction B2 toward a dump position. The joystick 10 is therefore movable along the linear path defining the first axis A from one position, through the neutral position, and to another position. The joystick 10 may further be movable along a second axis to control other aspects of the material handling machine 18 (e.g., raising/lowering the lift arm 22, operating the boom, moving or rotating the machine 18). The joystick 10 may be moved to locations other than along the first and second axes, such as positions that include displacement from the neutral position along both axes simultaneously. In such positions, the joystick 10 is considered to have moved along the first axis A despite the motion not being purely along the first axis A.

FIG. 2 illustrates an example of a hydraulic schematic of a system configured to convert the operator input at the joystick 10 into movement of the bucket 14. A hydraulically controlled pump 26, such as a purely hydraulic controlled pump or a pump with an active swash plate control, receives feedback from a load sensing line 30. Hydraulic cylinders 34A, 34B associated with the bucket 14 are controlled by an electrohydraulic proportional valve 38 with a pre-compensator 46. A controller 100 receives inputs (signals) from the joystick 10 and provides outputs (signals) to control the proportional valve 38 and/or the pump 26 based on the inputs. While the proportional valves 38 are shown as two-position valves, three-position valves (e.g., having a float position) or valves having more than three positions are also contemplated. In some embodiments, the pilot pressure is provided externally by a charge pump 42. In other embodiments, the pilot pressure can be generated internally by the valve 38. Further, in some embodiments, the load sensing line 30 may be omitted, relying instead on a pressure sensor for identifying the load. An inlet section 50 of the hydraulic system controls fluid pressure and may include components that assist in controlling the pump 26. The inlet section 50 is only one example of an inlet section that may be utilized. The schematic further illustrates the valve arrangements for two additional implements (in addition to the bucket 14; e.g., a boom, auxiliary hydraulics), though the respective cylinders are omitted.

In a primary mode of operation, the operator actuates the handle 12 of the joystick 10 from the neutral position towards either the curl position or the dump position. The pump 26 and proportional valve 38 are controlled based on the position of the joystick 10 along the axis to provide fluid to the hydraulic cylinders 34A, 34B, thereby rotating the bucket 14 in the desired direction, curling or dumping the bucket 14. The rotational velocity of the bucket 14 is controlled by the displacement of the joystick 10 from the neutral position, with higher velocity being associated with greater displacement. Rotational velocity of the bucket 14 is related to the volumetric flow rate to the cylinders 34A, 34B, with other factors (e.g., load within the bucket) also effecting the velocity. As such, when the joystick is displaced greater distances, the pump 26 and proportional valve 38 are electro-hydraulically controlled to provide more fluid to the cylinders 34A, 34B.

In some scenarios, such as when an item is lodged or otherwise stuck within the bucket 14, an operator conducts a bucket shake operation to quickly oscillate the bucket 14 in an attempt to dislodge the material from within the bucket. A manual bucket shake operation therefore involves oscillating the joystick 10 back and forth between the curl and dump positions to quickly shake the bucket 14. An automated bucket shake operation involves a separate user input to quickly shake the bucket 14 without manually oscillating the joystick 10.

The material handling machine 18 includes a second user input, a button 54 that is a momentary switch movable between an engaged position and a disengaged position. In the disengaged position, the joystick 10 operates in the primary mode of operation. In the engaged position, the automated bucket shake operation is operated and the functionality of the joystick 10 is modified to operate in a secondary, bucket shake mode of operation. As shown, the button 54 is located on the joystick 10, thereby allowing an operator to engage both of the joystick 10 and the button 54 simultaneously with a single hand. In other embodiments, the button 54 may be located elsewhere within reach of the operator. The button 54 is biased to the disengaged position and is held (by the operator) in the engaged position by depressing the button 54. When the operator removes pressure from the button 54, it returns to the disengaged position. In some embodiments, the button 54 is replaced by an alternative input such as a switch, a push-push button, or a capacitive or other touch interface.

When the button 54 is depressed, the controller 100 receives a signal to operate the machine 18 in a second mode of operation that conducts an automated bucket shake operation. The controller 100 is therefore programmed to receive a first signal from the joystick 10 corresponding to a position of the joystick 10, and is also programmed to receive a second signal from the button 54 corresponding to a status (engaged, disengaged) of the button 54. The controller 100 is also programmed to control the pump 26 and/or the valve assembly 38 to move the bucket 14 based on the first and second signals. The bucket shake operation begins automatically by depressing the button 54 (such that the button is in the engaged position) regardless of the position of the joystick 10. As such, the bucket shake operation occurs when the joystick 10 is in the neutral position and the button 54 is in the engaged position. The bucket shake operation likewise occurs when the joystick 10 is displaced from the neutral position (i.e., along the first axis A) and the button 54 is in the engaged position. When the operator removes pressure from the button 54, the button 54 returns to the biased disengaged position.

Movement of the joystick 10 in the secondary (automated bucket shake) mode of operation produces a different output than the same movement in the primary mode of operation. When in the second mode of operation, the bucket 14 is oscillating quickly between dump and curl positions, and therefore moving the joystick 10 toward the dump position or the curl position does not rotate the bucket in this direction (beyond the oscillating motion). Rather, movement of the joystick 10 along the first axis A, while in the secondary mode of operation, modifies the intensity of the bucket shake operation. Modifying the intensity may include modifying one or more of speed, acceleration, jerk (rate of change of acceleration), or range of motion. Written another way, the peaks of the oscillations within the bucket shake operation may be modified to be closer together/further apart, sharper/smoother, and/or higher/lower.

In one embodiment, as described in greater detail below, in the secondary mode of operation, moving the joystick 10 from the neutral position toward the dump position (i.e., in the direction D2) increases the intensity of the bucket shake operation (i.e., the intensity of the oscillatory motion) and moving the joystick 10 from the neutral position toward the curl position (i.e., in the direction D1) decreases the intensity. In another embodiment, the curl position may be associated with increased intensity and the dump position is associated with decreased intensity. The distance that the joystick 10 is displaced from the neutral position may correspond to the change in intensity (e.g., proportionally). The intensity when the joystick 10 is at the neutral position is a first intensity. When the joystick is moved toward the dump position, the intensity increases from the first intensity to a second, maximum, intensity at the dump limit (maximum displacement along the first axis A in the dump direction) of the joystick 10. Other intensities between the first and second intensities are achievable at joystick positions between the neutral position and the dump limit. Similarly, when the joystick 10 is moved toward the curl position, the intensity decreases from the first intensity to a third, minimum intensity at the curl limit (maximum displacement along the first axis A in the curl direction) of the joystick 10. Other intensities between the first and third intensities are achievable at joystick positions between the neutral position and the curl limit. If the joystick 10 is movable along the second axis, such movement does not have a bearing on the intensity of the bucket shake operation.

The intensity of the oscillating motion of the bucket shake operation can be modified by adjusting parameters of the pump 26. For a purely hydraulically controlled pump 26, bucket shake is achieved by switching between dump and curl positions with the following adjustable parameters: minimum dump current, maximum dump current, dump period, minimum curl current, maximum curl current, and curl period. If the pump 26 has a controllable swash plate, displacement dump and displacement curl are two additional parameters of the bucket shake algorithm that will aid in defining frequency and amplitude of the oscillating motion of the bucket shake operation. A predefined combination of these parameters is set as a predefined, default shake condition that corresponds to the neutral position of the joystick 10.

The joystick 10 may have a dead zone 60 along the first axis A directly adjacent to the neutral position. The dead zone 60 is limited to small movements from the neutral position. In the dead zone 60, movement of the joystick 10 does not result in a registered input. As such, in the secondary mode of operation, movement of the joystick 10 within the dead zone 60 does not result in a modification of the intensity of bucket shake operation. The intensity therefore monotonically increases (i.e., does not decrease) from a minimum intensity at one of the extreme positions along the axis A, leveling out at the dead zone 60, and increasing from the dead zone 60 to a maximum intensity at the other extreme position along the axis A.

Figure 3:
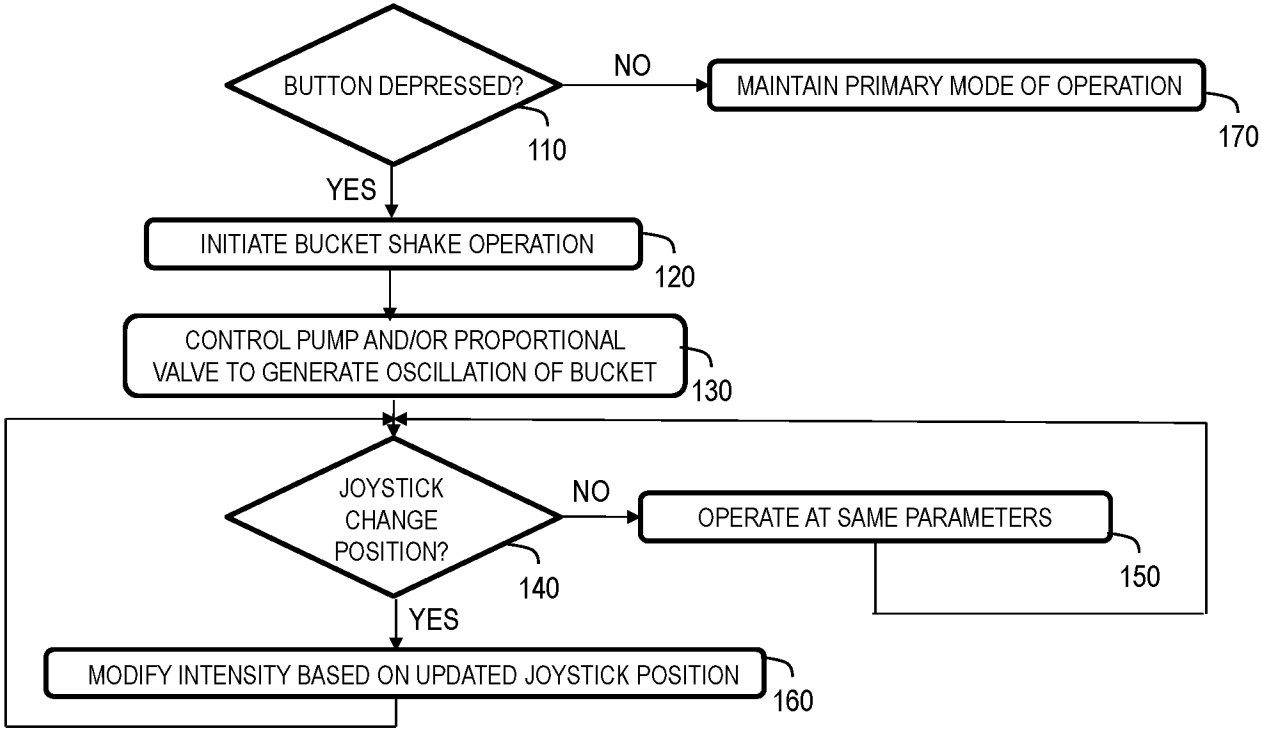
FIG. 3 is a flowchart detailing a bucket shake operation.

In operation and with reference to FIG. 3, if the operator identifies that material is stuck within the bucket 14, the operator depresses the button 54 (step 110), thereby initiating the bucket shake operation (step 120). The pump 26 and proportional valve 38 are actuated by the controller 100 to alternate which chamber of the two hydraulic cylinders 34A, 34B associated with the bucket 14 receives the volumetric flow to move the bucket 14 in an oscillating motion in an attempt to dislodge the material from the bucket 14 (step 130). The controller 100 monitors the position of the joystick 10 (step 140). If the joystick 10 is in the neutral position, the bucket shake operation will operate with a predefined intensity (i.e., speed, acceleration, jerk, and/or magnitude) (step 150). If the operator decides that the bucket shake operation is too intense or wants a smoother, more subtle bucket shake operation (e.g., attempting to slowly shake out the contents of the bucket 14), the operator moves the joystick 10 along the first axis A toward the curl position (i.e., in the direction D1), holding the joystick 10 at a position that corresponds to the desired intensity. If the operator decides that the bucket shake operation is too subtle or wants a more intense bucket shake operation (e.g., if the predefined intensity is insufficient to dislodge the material), the operator moves the joystick 10 along the first axis A toward the dump position (i.e., in the direction D2), holding the joystick 10 at a position that corresponds to the desired intensity. The joystick 10 can be moved from the neutral position while in the bucket shake operation (e.g., after identifying that the predefined intensity is undesirable) or prior to initiating the bucket shake operation (e.g., if the operator is aware based on prior experience that the desired bucket shake operation differs from the predefined bucket shake operation) (step 160). When the material is dislodged from the bucket 14, the operator releases the button 54, returning it to the disengaged position, and returns the joystick 10 to the neutral position. Similarly, if the button 54 is not depressed, the system operates in the primary mode of operation (step 170).

Although some aspects have been described in detail with reference to certain preferred embodiments, variations and modifications exist within the scope and spirit of one or more independent aspects as described. Various features and advantages of the invention are set forth in the following claims.

What is claimed is:

1. An apparatus for facilitating bucket movement of a material handling machine, the apparatus comprising:

a first operator input movable between a neutral position, a first position and a second position;

a second operator input actuatable from a disengaged position to an engaged position; and a controller programmed to operate the first operator input in a first mode of operation when the second operator input is in the disengaged position and programmed to operate the first operator input in a second mode of operation when the second operator input is in the engaged position; and wherein, in the first mode of operation, the controller is programmed to curl a bucket of the apparatus when the first operator input is displaced from the neutral position toward the first position and is programmed to dump the bucket of the apparatus when the first operator input is displaced from the neutral position toward the second position, and wherein, in the second mode of operation, the controller is programmed to move the bucket in an oscillatory motion and an intensity of the oscillatory motion is dependent upon a position of the first operator input, wherein the intensity of the oscillatory motion is a first intensity when the first operator input is in the neutral position, wherein the controller is programmed to increase the intensity of the oscillatory motion relative to the first intensity to a second intensity at the first position, and wherein the controller is programmed to decrease the intensity of the oscillatory motion relative to the first intensity to a third intensity at the second position.

2. The apparatus of claim 1, wherein the first operator input is a joystick biased to the neutral position.

3. The apparatus of claim 1, wherein the second operator input is a switch biased to the disengaged position.

4. The apparatus of claim 1, wherein the first operator input is movable along a linear path from the first position, through the neutral position, and to the second position.

5. The apparatus of claim 1, wherein the second operator input is mounted to the first operator input.

6. The apparatus of claim 1, wherein the controller is programmed to receive a first signal from the first operator input corresponding to a position of the first operator input, is programmed to receive a second signal from the second operator input corresponding to a status of the second operator input, and is programmed to control one or both of a pump and a valve assembly of the apparatus to move the bucket based on the first and second signals.

7. The apparatus of claim 1, wherein the apparatus is configured to transition from the first mode of operation to the second mode of operation irrespective of the position of the first operator input.

8. An apparatus for facilitating bucket movement of a material handling machine, the apparatus comprising:

a joystick biased to a neutral position and movable from the neutral position to a maximum dump position and a maximum curl position;

an operator input movable between a disengaged position and an engaged position, and a controller programmed to automatically move a bucket of the material handling machine in an oscillatory motion when the operator input is in the engaged position, regardless of a position of the joystick;

wherein the controller is programmed to vary an intensity of the oscillation dependent upon the position of the joystick, a maximum intensity corresponding to the joystick in one of the maximum dump position or the maximum curl position, and a minimum intensity corresponding to the joystick in the other one of the maximum dump position or the maximum curl position.

9. The apparatus of claim 8, wherein the operator input is biased to the disengaged position.

10. The apparatus of claim 8, wherein the joystick is movable along an axis from the maximum dump position to the neutral position to the maximum curl position.

11. The apparatus of claim 10, wherein the controller is programmed to monotonically increase the intensity of the oscillation as the joystick moves in a first direction along the axis when the operator input is in the engaged position.

12. The apparatus of claim 8, wherein the operator input is positioned on the joystick such that the operator input and the joystick are configured to be simultaneously engaged by a single hand of a user.

13. The apparatus of claim 8, wherein the operator input is a switch biased to the disengaged position.

14. An apparatus for facilitating bucket movement of a material handling machine, the apparatus comprising:

a joystick biased to a neutral position, movable away from the neutral position in a first direction along an axis to a first position, and movable away from the neutral position in a second direction along the axis, opposite the first direction, to a second position;

an operator input movable from a disengaged position to an engaged position, and a controller programmed to automatically move a bucket of the material handling machine in an oscillatory motion when the operator input is in the engaged position;

wherein, when the operator input is in the engaged position, the controller is programmed to vary an intensity of the oscillation dependent upon a position of the joystick along the axis, the intensity decreasing along the axis from the first position to the second position.

15. The apparatus of claim 14, wherein the operator input is biased to the disengaged position.

16. The apparatus of claim 14, wherein, when the operator input is in the disengaged position, one of the first position or the second position corresponds to a dump position of the bucket and the other of the first position or the second position corresponds to a curl position of the bucket.

17. The apparatus of claim 14, wherein controller is programmed to monotonically increase the intensity of the oscillation in a first direction as the joystick moves along the axis when the operator input is in the engaged position such that the intensity at the neutral position is greater than the intensity at the first position and is less than the intensity at the second position.

18. The apparatus of claim 14, wherein the operator input is positioned on the joystick such that the operator input and the joystick are configured to be simultaneously engaged by a single hand of a user.

19. The apparatus of claim 14, wherein the controller is programmed to receive a first signal from the joystick corresponding to a position of the joystick along the axis, is programmed to receive a second signal from the operator input corresponding to a status of the second operator input, and is programmed to control a valve assembly of the apparatus to move the bucket based on the first and second signals.

20. The apparatus of claim 14, wherein the axis is a first axis, and wherein the joystick is movable away from the neutral position along a second axis, wherein the intensity of the oscillation is independent of a position of the joystick along the second axis.

* * * * *